United States Patent [19]

Gunn

[11] 4,256,151

[45] Mar. 17, 1981

[54] SYSTEM FOR DISPENSING A VOLATILE FUEL

[75] Inventor: Kenneth M. Gunn, Glenham, N.Y.

[73] Assignee: Texaco Inc., White Plains, N.Y.

[21] Appl. No.: 24,145

[22] Filed: Mar. 26, 1979

[51] Int. Cl.[3] ..... B65B 31/04

[52] U.S. Cl. ..... 141/59; 141/206; 141/301

[58] Field of Search ..... 141/37-64, 141/1-8, 285-310, 351-362, 382-386, 192-229, 392; 137/100, 269, 85; 251/282, 61.4; 220/85 VR, 85 VS; 403/50, 51; 222/318

[56] References Cited

U.S. PATENT DOCUMENTS

| | | | |
|---|---|---|---|
| 3,874,427 | 4/1975 | Tiggelbeck | 141/52 |
| 4,020,861 | 5/1977 | Shihabi | 141/59 |
| 4,057,085 | 11/1977 | Shihabi | 141/59 |
| 4,057,086 | 11/1977 | Healy | 141/44 |
| 4,068,687 | 1/1978 | Long | 141/59 |
| 4,082,122 | 4/1978 | McGahey | 141/59 |
| 4,095,626 | 6/1978 | Healy | 141/59 |

*Primary Examiner*—Houston S. Bell, Jr.
*Attorney, Agent, or Firm*—Carl G. Ries; Robert A. Kulason; Robert B. Burns

[57] ABSTRACT

System for transferring a volatile liquid fuel from a common source, into one or more of a plurality of dispensing nozzles. The latter can be individually or simultaneously operated to service one or more vehicles. The system avoids passage of fuel vapors into the atmosphere during the transfer operation by providing a preferential path back into the fuel tank or other vapor storage devices through a central, vacuum assist apparatus. It further includes devices to avoid the inadvertent accumulation of condensate in the vapor lines by passing liquid around the vapor metering valve and directing it to a vapor receptacle.

7 Claims, 4 Drawing Figures

SYSTEM FOR DISPENSING A VOLATILE FUEL

BACKGROUND OF THE INVENTION

During the transfer of a volatile liquid such as gasoline or a similar fuel from a storage facility, there may be an unsealed connection made between the disconnectable nozzle and the tank being filled. As the transfer operation progresses, residual gases as well as air contained in the tank, sometimes are displaced into the atmosphere.

Many municipalities and governmental agencies have proposed or adopted regulations intended to reduce or at least control these emissions. One method toward complying with mandated regulations is the provision of a substantially, or completely closed system between the fuel source or storage facility and the tank or tanks being filled.

Such a closed system normally includes individual conduits which carry the vaporizable fuel. The remote end of each conduit is provided with a manually operated dispensing nozzle. The nozzles are adapted to be removably positioned within the filler pipe of a receiving tank. Further, they include means to form a partially sealed engagement between the nozzle spout and the tank filler tube.

Also, in some instances, the fuel carrying system is not fully closed, but rather is controllably vented to the atmosphere. With such an arrangement, as liquid is pumped from the source, either of two eventualities could occur. If fuel leaving the storage reservoir or source is not immediately replaced by vapor from the tank being filled, air will be drawn into the system. On the other hand, when excessive vapors are withdrawn from the tank being filled, some vapors will have to be vented to the atmosphere to avoid a pressure build-up.

Several embodiments of sealing arrangements have been found to be advantageous for providing the necessary partial or substantially vapor tight, yet disconnectable engagement at the nozzle spout. One method for providing the desired engagement, is to attach a cylindrical, flexible walled member such as a rubber boot or the like, to each fuel dispensing nozzle.

The boot, when properly positioned, will substantially surround the nozzle spout when the latter is registered in place. By use of such an arrangement, when a nozzle is registered in a filler pipe of the receiving tank, the walls of the flexible boot will be deflected and/or distorted. The boot will thereby define an annular vapor tight, or substantially vapor tight passage.

This type of arrangement has generally been found to be highly effective. Thus, when a fuel flow is introduced from a nozzle into a particular receiving tank, a slight pressure is produced within the tank to displace a mixture of air and fuel vapors. These displaced vapors will be urged upwardly through the annulus defined by the nozzle spout and the flexible member. Said vapors can then be transferred by way of the dispensing nozzle through a separate conduit to the fuel source, or to another reservoir for retaining the vapors.

The effectiveness of this system depends to a large degree on the mechanical compatibility of the vehicle fuel tank with the nozzle to permit a satisfactory mating relationship at their interface. If for any reason the contact edge of the nozzle boot does not engage the filler pipe, an imperfect seal arrangement is achieved and some vapor leakage can occur.

In conjunction with closed fuel systems, vacuum assist means have been devised which cause the vapor collection system to operate under a slight vacuum. Operationally, the vacuum system will function to establish a reduced pressure at the nozzle-tank filler pipe juncture to collect the displaced vapor by aspiration.

In the presently disclosed arrangement, a system is provided which incorporates a number of features which include: (1) provision for compensating for an imperfect seal at the vehicle tank-nozzle interface, (2) a vacuum assist means adapted to aid in withdrawing and collecting vapors from those vehicles being serviced, and (3) a common blower or vapor inductor system which is manifolded to a plurality of fuel dispensing units, which system will stabilize the vacuum condition at each nozzle regardless of how many of the latter are in operation at any one time. Means is also provided for protecting the vapor system by withdrawing liquid therefrom which is formed by condensing vapor.

The instant system thus provides a fuel dispensing or vehicle service facility which embodies a plurality of pumps or fuel filling units. A vapor return segment is incorporated into the fuel dispensing segment of the system.

Functionally, as a fuel transfer operation at any one or more of the several dispensers commences, a blower in the vapor segment is concurrently actuated. Fuel passing through the dispensing facility further actuates a flow regulating valve which in turn regulates the vapor flow from that particular dispenser. Condensate in the vapor system bypasses the regulator valve and flows directly to a storage means. Thereafter, the system's main blower will continuously operate to collect vapors and direct them to storage so long as any one or more of the individual regulating valves is operable to communicate one or more of the dispensers with the vapor withdrawal system.

Toward assuring the operation of the overall system under varying circumstances, a vapor blower is provided having a capacity greatly in excess of the volume of vapor to be removed. A valved bypass conduit is provided across the vapor blower or inductor to recirculate vapors from the blower discharge, back through the blower's suction side. This arrangement maintains a substantially constant vacuum condition in the system, regardless of the vapor flow rate from the respective dispensers.

An object of the invention therefore is to provide a fuel system for a multi-station fuel dispensing facility, which system embodies a dispensing nozzle adapted to removably engage a fuel receiving tank. A further object is to provide a vapor collecting system of the type contemplated which is actuated in response to the inflow of fuel to the receiving tank. A still further object is to provide a vacuum assist arrangement within a fuel system having a plurality of dispensing nozzles, operation of the vapor portion being assured by providing means to remove condensate from the vapor carrying segment of the system.

DESCRIPTION OF THE DRAWINGS

In the drawings,

Referring to FIG. 1, the drawings illustrate an installation of the type contemplated, preferably a sevice or refueling station for vehicles, boats, etc., wherein the present vacuum assist and the condensate drain arrangement are incorporated. The installation as shown includes primarily a reservoir or storage tank 10 which is normally buried beneath the ground. A venting means 11 extends from the upper end of the storage tank. This feature permits passage of vapors into the atmosphere at such times as the pressure within tank 10 exceeds a predetermined desired level.

Figure 1:
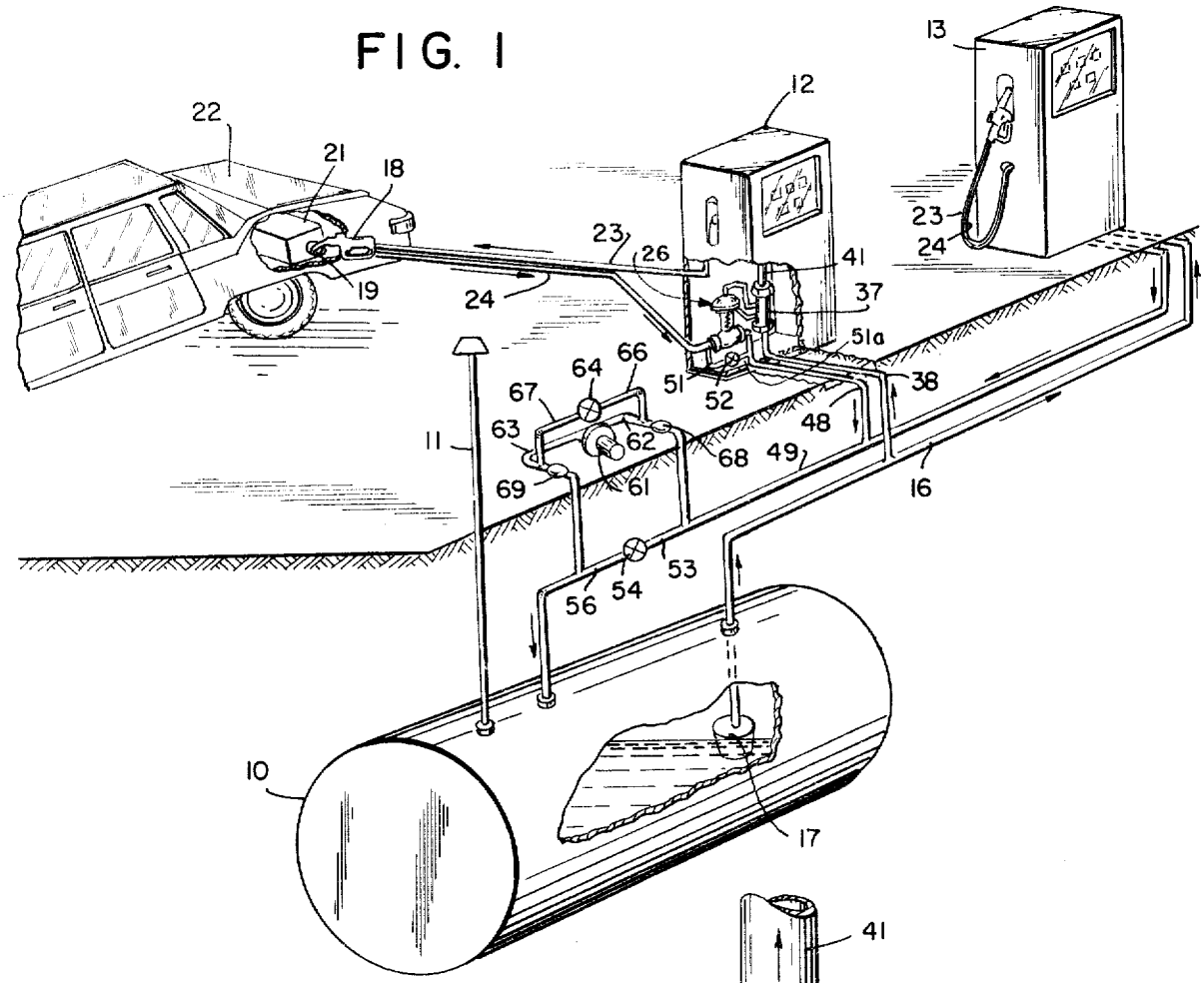
FIG. 1 represents an environmental arrangement of the presently disclosed closed fuel system which is capable of connecting an underground storage tank with one or more receiving tanks to be filled.

In accordance with the general arrangement of most automotive filling stations the installation is provided with a series of terminal stations 12 and 13. Frequently each station will dispense a different grade of fuel. In the arrangement shown, however, all the stations handle the same fuel. Normally, a vehicle can temporarily park adjacent to one of said stations to receive a transfer of fuel.

Each terminal station is supplied from a principal liquid fuel carrying manifold 16. Said manifold 16 is in turn communicated with a reservoir or with storage tank 10 by way of pump 17. Operationally, although not shown in detail, a metering means at each terminal station is actuated to register fuel flow.

Each terminal station, 12 for example, further includes a dispensing nozzle 18 which is manually operable to regulate the fuel flow therethrough. To function in the instant system, dispensing nozzle 18 is adapted to be registered within the filler pipe 19 of a receiving tank 21, of a vehicle 22.

Nozzle 18 is provided with means for establishing the necessary removable, yet vapor tight engagement, preferably in close relationship with tank 21. Engagement is initiated by inserting nozzle 18 into the receiving tank filler pipe 19 a sufficient distance to form a substantially vapor tight seal between the filler pipe lip, and a deformable member depending from the nozzle.

Sealable nozzles of this type are well known in the art, and a number of embodiments have been widely used to establish the desired close, or substantially vapor tight relationship with a receiving tank.

Further, and as mentioned, although not instantly shown, each terminal station such as 12 usually includes a means by which fuel flow can be manually initiated at the dispensing nozzle 18. Switching means is also provided at each terminal station, and is manually actuated by an operator upon removal of nozzle 18. This latter feature is not shown specifically since it also is a concept well known in the art and long used in service stations of the type contemplated.

To remove vapors including both fuel and air from a receiving tank 21 during a fuel transfer operation, nozzle 18 is provided with internal valved passages which carry the liquid. The nozzle is further provided with discrete passages for removing vapors which are displaced from tank 21. Said vapors when withdrawn, are introduced to a vapor return line 24 and conducted back to terminal station 12.

Figure 2:
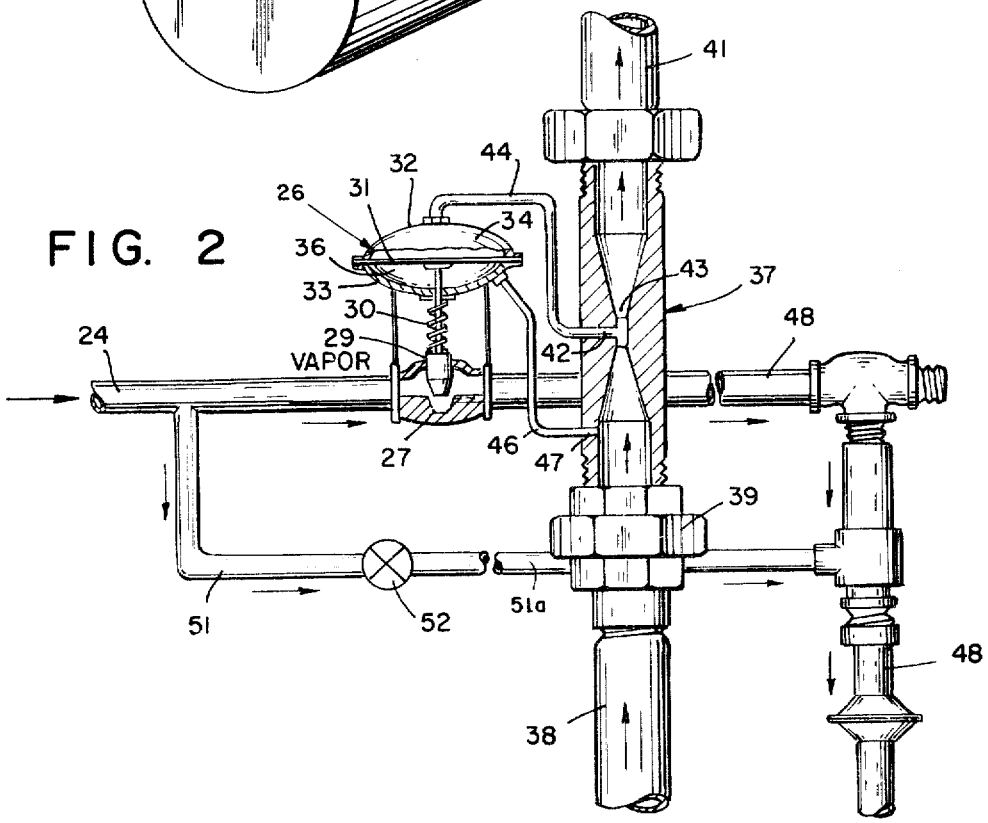
FIG. 2 is similar to FIG. 1, illustrating parts of the integrated fuel and vapor segments schematically to show internal working parts thereof.
Figure 3:
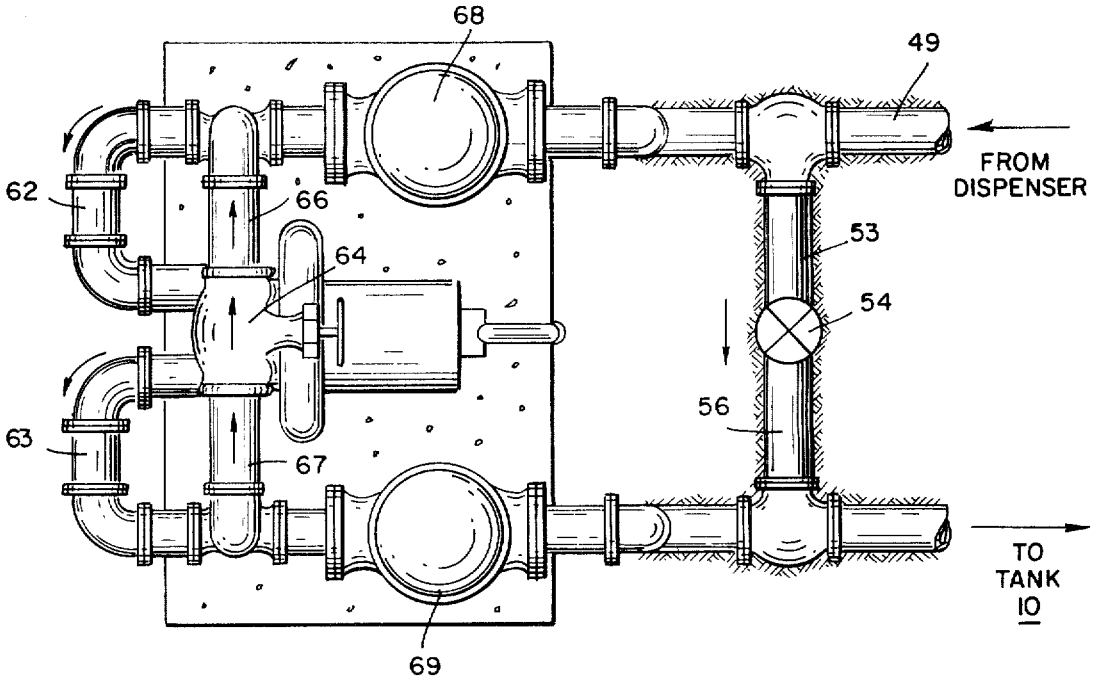
FIGS. 3 and 4 are segmentary views on an enlarged scale, of the blower portion of FIG. 1.
Figure 4:
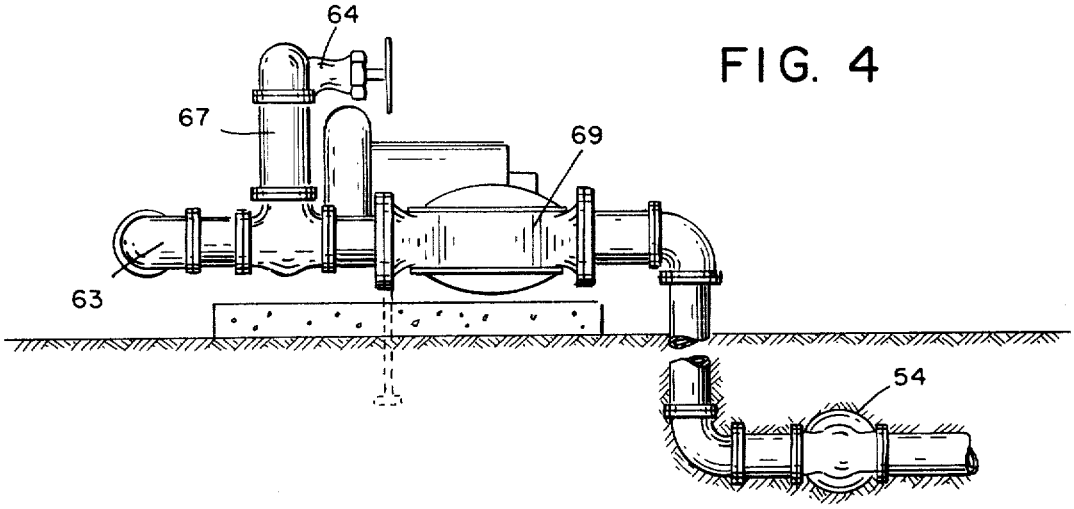

At terminal station 12, and referring to FIG. 2, a fluid regulating valve 26 is provided to control vapor which flows from conduit 24 back to reservoir or tank 10. Thus, valve 26 comprises in essence a vapor flow regulating passage 27 having a flow adjusting element 28 normally registered therein.

Flow adjusting element 28 includes an elongated stem 29 which depends from the adjusting ball, plate or the like. Said stem 29 is fixed at its upper end to a flexible diaphragm 31. The latter is held in place between corresponding peripheral rims on upper and lower valve casings 32 and 33, respectively. Thus, the displaceable diaphragm 31 defines adjacent plenum chambers 34 and 36.

A spring 30 is operably compressed between the lower side of casing 33 and the lower end of stem 29. Functionally spring 30 urges element 28 into a normally closed disposition with respect to the flow passage 27, whereby to discontinue vapor flow through the latter.

A venturi section 37 is communicated at its inlet end with liquid conduit 38, by way of pipe coupling 39. The upper end of venturi 37 is communicated with a suitable metering or flow registering means within fuel dispenser 12 by way of conduit 41. While not presently shown, the internal workings of such a dispenser are well known in the art and function, when the system is actuated, to pass a stream of fuel therethrough. Concurrently, they will register the volume as well as the cost to a customer on a visual scale.

Venturi 37 includes a vapor tap 42 at the constricted throat section 43. A connector line 44 communicates throat 43 with plenum chamber 34. A second connector line 46 communicates plenum chamber 36 with the upstream tap 47 of the venturi.

Operationally, as fuel flow is initiated and passed through venturi 37 in response to actuation of pump 17, a pressure differential will be established between throat 43 and tap 47. The pressure differential will be registered in chambers 34 and 36 respectively such that diaphragm 31 will be deflected toward the lower pressure side, chamber 34.

Stem 29 will thus be raised up against the force of spring 30 to open the vapor flow passage 27.

Concurrently with the passage of liquid fuel through venturi 37 and thence to nozzle 18, vapor will be forced from tank 21 and into vapor conduit 24. Thereafter, the vapor will enter valve flow passage 27 and be conducted by conduit 48 to vapor return header 49.

As shown in FIG. 2, during periods of non-operation, when no fuel passes through constricted throat 43, no pressure differential will exist between taps 43 and 47. With the resulting equalization of pressures in chambers 34 and 36, spring 30 will urge the valve stem 29 downwardly to close the flow passage 27.

During a tank filling operation there will ordinarily be a continuous vapor flow between conduit 24 and conduit 48 by way of valve passage 27. However, under certain atmospheric conditions, vapor within the various passages between fuel tank 21 and valve passage 27 there is likelihood that there will be sufficient condensation to form a blocking puddle within the vapor passage. Such a blockage would of course disrupt the entire system since there would no longer be a free passage of vapor in response to commencing the liquid flow.

To preclude the forming of a passage blocking situation, liquid bypass means is provided in the form of a conduit, which connects the upstream and downstream sides of the vapor regulating passage 27. Said bypass includes a conduit or pipe connection 51 which communicates with vapor conduit 24 and is preferably fixedly positioned at a downward slope such that any liquid accumulating within vapor conduit 24 will flow downwardly into the bypass member. From the latter, liquid can readily pass into conductor 48 and thence into vapor return header 49 for return to storage tank 10.

To avoid the circulation of vapor through valve 27 due to the bypass members 51 and 51a, the latter can be provided with a suitable valve means 52 to permit liquid flow only in response to accumulation thereof, at the upstream side of the valve. Thus, the valve will have the usual characteristics of permitting liquid flow to conduit 48 in response to a liquid pressure build-up, yet prohibiting vapor flow from the storage tank 10 backward through the bypass.

Should any liquid or vapor condensate accumulate in lines 48 and 49, the latter are positioned at a downward slope toward storage tank 10 to permit gravity flow to the latter into the tank. Further, a second liquid bypass system, including conduit 53, together with a pressure responsive valve 54, is interposed in line 49. The downstream side of valve 54 is communicated with tank 10 by line 56 such that liquid cannot form a blockage in any section of the vapor system.

To assure a constant flow or drawing of vapor from the various pumping stations 12 and 13 regardless of the number of such stations which are in operation, and regardless of the rate of fuel being pumped, vapor circulating circuit is included in the system. Said vapor circulating circuit includes in essence a vapor inductor apparatus 61 which can be a fan or the like, which is preferably motor driven. Operation of the latter can be commenced in response to actuation of the overall fuel system.

The inlet 61a of said inductor 61 is communicated with header 49, by way of line 71 and the inductor discharge side **61*b* is communicated by line 72 with a point downstream of the vapor bypass valve 54. A second bypass arrangement includes a conduit 73 which is communicated with discharge 61*b* and with a bypass valve 74**, respectively.

The downstream side of said valve 74 is connected through the second conduit 76 to the inlet **61*a* of impeller 61. Thus, as the system operates, the amount of vapor drawn into the vapor circulating circuit defined by impeller 61 and its bypass valve 74**, will be greatly in excess of that amount of vapor which would normally be drawn from the tank being filled.

Vapor from the vapor circulating circuit is deposited into reservoir 10 by line 72, from which liquid fuel was initially drawn. It is understood, however, that said vapor can likewise be deposited in a suitable alternate receptacle or reservoir. Such alternative will depend on the capability of the facility for receiving and storing the vapors.

Valve 74 is normally preset to afford a desired rate of vapor recirculated through inductor 61. Said vapor flow is preferably greatly in excess of the amount of vapor which is to be withdrawn collectively from the respective dispensing stations. Recirculated flow through inductor 61 can thus be preferably 5 to 10 times the maximum vapor flow which is expected to be taken from the respective dispensing stations 12 and 13.

As a safety measure the vapor inductor 61 can be provided with flame arresting means 77 and 78 disposed upstream and/or downstream thereof to prevent propagation of flame as a result of any inadvertent ignition of vapors which pass through the inductor circuit 61.

Operationally, the instant vacuum assist system is capable of servicing a single vehicle, or a multiplicity of vehicles simultaneously from the respective terminal stations 12 and 13. However, to maintain a desirable degree of vacuum assist at each of the terminal stations, and consequently at the respective dispensing nozzles 18, each of the dispensing stations is individually regulated. Each of the flow regulating valves therefore provides the desired degree of vapor flow control, which, together with the vapor flow through the vapor recirculating circuit, regulate and stabilize the degree of vacuum at each nozzle.

Other modifications and variations of the invention as hereinbefore set forth can be made without departing from the spirit and scope thereof, and therefore, only such limitations should be imposed as are indicated in the appended claims.

I claim:

1. In a volatile liquid dispensing system which includes; a liquid circuit adapted to pump a stream of a volatile liquid from a reservoir thereof to two or more liquid dispensers, and thence to a receiving tank (21), which system includes;

a vapor circuit to concurrently conduct vapor from said receiving tank (21) to a vapor storage facility, pump means (17) having an inlet communicated with liquid in said reservoir (10), a venturi (37) in said liquid circuit being connected with the discharge of said pump (17) to receive a stream of liquid therefrom, said venturi having high pressure and low pressure taps (47 and 42) respectively, valve means (26) including a valve element (27) communicated with said vapor storage facility and having a pressure sensitive valve operator (31, 34, 36) operably engaged therewith for adjusting said valve between open and closed positions, and connecting means (44 and 46) communicating said venturi (37) with said pressure sensitive valve operator to transmit a pressure differential thereto when the stream of liquid passes through said venturi whereby to open said valve element (27) to a vapor flow, and a liquid bypass means (**51, 52, 51*a***) within said vapor circuit positioned to prevent liquid accumulation therein.

2. In the system as defined in claim 1, including; a liquid bypass means in said vapor circuit communicating said vapor circuit with said vapor storage facility.

3. In the system as defined in claim 2, including; a liquid bypass means within said vapor circuit communicating the latter with said liquid containing reservoir.

4. In the system as defined in claim 2, wherein said liquid bypass means includes, valve means therein adapted to open in response to the pressure of liquid within said vapor system.

5. In the system as defined in claim 1, wherein said valve mean operator includes; a chamber, and a flexible diaphragm disposed within said chamber to define the latter into adjacent plenum chambers, each of said plenum chambers being communicated with said high pressure and low pressure taps respectively at said venturi.

6. In the system as defined in claim 5, wherein said valve means includes; a stem operably connecting said valve element with said diaphragm.

7. In the system as defined in claim 6, wherein said valve stem includes; a biasing spring connected therewith to urge said valve into a normally closed position when no liquid passes through said venturi.

* * * * *